US005467490A

United States Patent [19]

Rice

[11] Patent Number: 5,467,490

[45] Date of Patent: Nov. 21, 1995

[54] NECK CRADLE

[76] Inventor: Susan F. Rice, P.O. Box 54, Valentines, Va. 23887

[21] Appl. No.: 251,240

[22] Filed: May 31, 1994

[51] Int. Cl.[6] ..... A47G 9/00

[52] U.S. Cl. ..... 5/636; 5/640; 601/115

[58] Field of Search ..... 5/636, 640, 643; 601/115, 122, 128, 124, 132

[56] References Cited

U.S. PATENT DOCUMENTS

| | | | |
|---|---|---|---|
| 1,265,083 | 5/1918 | Hoard | 601/115 |
| 2,239,003 | 4/1941 | Jones | 5/640 |
| 2,769,184 | 11/1956 | Collica . | |
| 3,258,790 | 7/1966 | Maru | 5/636 |
| 4,074,373 | 2/1978 | Garofalo | 5/640 |
| 5,337,429 | 8/1994 | Tucker | 5/636 |
| 5,343,582 | 9/1994 | Baylor | 5/636 |

FOREIGN PATENT DOCUMENTS

| | | | |
|---|---|---|---|
| 441537 | 8/1912 | France | 601/124 |
| 464443 | 12/1968 | Switzerland | 601/124 |

*Primary Examiner*—Flemming Saether

[57] ABSTRACT

A neck cradle including an elongated flexible bar member disposed between two adjustable supports. In use, an upward facing prone human rests the neck upon the bar member and may perform side to side rocking motions which massage the occipital ridge region having a general therapeutic effect. In an alternate embodiment, sets of three beads in two sizes are disposed upon a plurality of short axles fixed between two rails attached to adjustable upright supports.

10 Claims, 4 Drawing Sheets

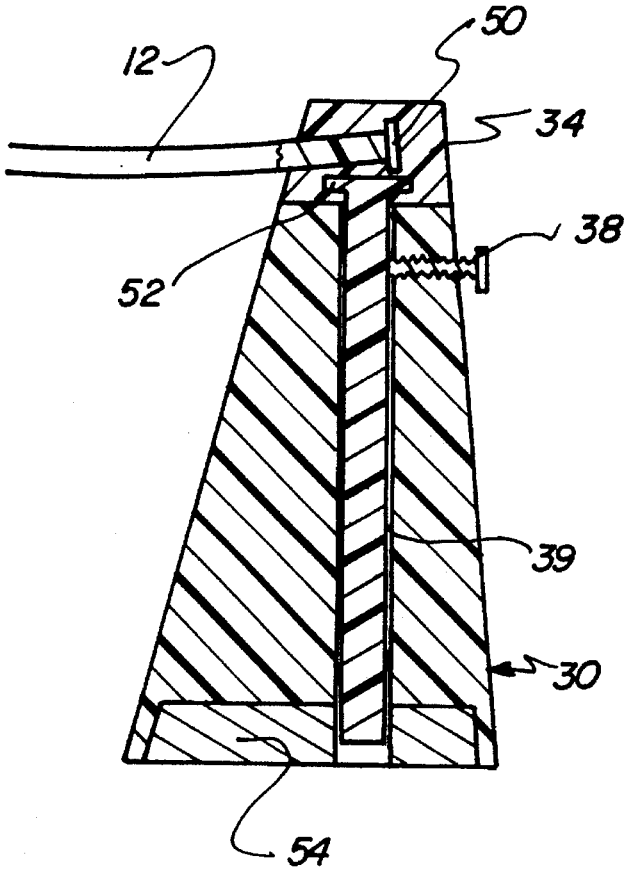
Fig. 5
Fig. 6
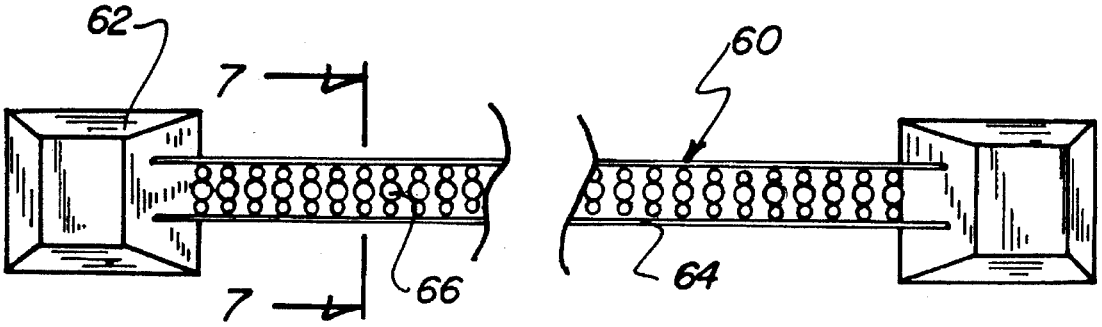

NECK CRADLE

BACKGROUND OF THE INVENTION

1. Field of the Invention

The present invention relates to therapeutic neck supports and more particularly pertains to a neck cradle which may be employed to support the neck at or near the occipital ridge thereby relieving muscle tension in the neck and shoulder region.

2. Description of the Prior Art

The use of therapeutic neck supports is known in the prior art. More specifically, therapeutic neck supports heretofore devised and utilized for supporting the occipital ridge are known to consist basically of familiar, expected and obvious structural configurations, notwithstanding the myriad of designs encompassed by the crowded prior art which have been developed for the fulfillment of countless objectives and requirements.

The present invention is directed to improving devices for a neck cradle in a manner which is safe, secure, economical and aesthetically pleasing.

For example, U.S. Des. Pat. No. 323,218 to Kamensky discloses the ornamental design of a combined neck and head support comprising a contoured panel member having two flexible adjustable strap members affixed thereon by threaded engagement with slots disposed therein. The Kamensky invention does not provide occipital ridge support solely and is rather directed toward immobilizing the neck and head by disposing even support thereon by means of a contoured support panel. The present invention has no strap members and comprises a resilient rodlike member supported at both free ends thereof and engaging the occipital ridge region of the neck of a prone individual lying face upward and furthermore is employed to provide tension relief of neck and shoulder musculatures.

In U.S. Des. Pat. No. 244,871 to Vincenti the ornamental design of a massager-exerciser for neck and back is disclosed. The Vincenti invention comprises an elongated platelike structure supported by three knoblike legs and having a plurality of hemi-ellipsoidal members affixed in a radiating pattern emergent from a central site thereon. The Vincenti invention has no provision for concentrated support of the neck at the occipital ridge. The present invention supports the neck of a prone upward facing individual in the region of the occipital ridge using an elongated flexible rodlike member supported at both free ends thereof.

In U.S. Pat. No. 5,108,150 to Stas et al. a head rest and neck support assembly is described. The Stas et al. invention comprises an elongated bar mounted horizontally behind the neck of the user and furthermore having a pivoting carrying arm with a cushion attached thereto. The Stas et al. invention is employed for the comfort of seated users and is not generally capable of supporting the occipital ridge of an upward facing prone individual for therapeutic purposes. The present invention comprises a flexible rodlike member disposed between two upright supports wherein the rodlike member engages the occipital ridge region of the neck of an upward facing prone individual thereby providing therapeutic muscle stimulation and relaxation.

In U.S. Pat. No. 4,829,614 to Harper an adjustable pillow with neck support is disclosed for supporting the head and neck by means of a plurality of horizontally disposed tubes susceptible to air fill at various pressures. The extent of air fill establishes an amount of support provided to the neck or head regions. A disadvantage in this prior art lies in a lack of directed support and massage to the occipital ridge portion of the neck. The present invention provides support and user induced massage of the occipital ridge region of the neck and thereby produces therapeutic benefits for the user.

U.S. Des. Pat. No. 337,626 to Iverson discloses the ornamental design of a neck massager. The disclosure teaches a garmentlike article disposed over the neck and shoulder portions of an individual. The disclosure makes no provision for directed support of the occipital ridge portion of the neck of an individual. Furthermore, there are no provisions for providing user induced highly localized massage of the occipital ridge region of the neck. The present invention comprises a horizontally disposed flexible rodlike member engaging the occipital ridge region of the neck of an upward facing prone individual thereby providing support and an opportunity for user induced localized massage of the occipital ridge region.

In this respect, the neck cradle according to the present invention substantially departs from the conventional concepts and designs of the prior art, and in so doing provides an apparatus primarily developed for the purpose of providing therapeutic and relaxational support of the occipital ridge region of the neck.

Therefore, it can be appreciated that there exists a continuing need for new and improved neck cradle which can be employed to provide tension releasing support of the occipital ridge region of the neck and to enable localized user induced massage thereof. In this regard, the present invention substantially fulfills this need.

As illustrated by the background art, efforts are continuously being made in an attempt to improve neck supports. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of neck supports now present in the prior art, the present invention provides an improved cervical support construction wherein the same can be utilized for relieving tension of muscles in the atlanto-occipital region of the neck. As such, the general purpose of the present invention, which will be described subsequently in greater detail, is to provide a new and improved neck cradle apparatus and method which has all the advantages of the prior art neck supports and none of the disadvantages.

The invention is defined by the appended claims with the specific embodiment shown in the attached drawings. For the purpose of summarizing the invention, the invention may be incorporated into a horizontally disposed flexible rodlike cervical engaging member disposed between two supports. When operationally disposed, the cervical support member renders a component of force to the posterior basilar part of the occipital bone substantially along the axis of the posterior longitudinal ligament and a component of force substantially normal to the cervical spine in the region of the posterior atlanto-occipital membrane, wherein the combined effects of these forces comprise a modality of significant use in physical therapy.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved neck cradle providing support of the occipital ridge region of the neck of an upward facing prone individual.

It is therefore an additional object of the present invention to provide a new and improved neck cradle which has all the advantages of the prior art neck supports and none of the disadvantages.

It is another object of the present invention to provide a new and improved neck cradle which may be easily and efficiently manufactured and marketed.

It is a further object of the present invention to provide a new and improved neck cradle which is of a durable and reliable construction.

An even further object of the present invention is to provide a new and improved neck cradle which is susceptible of a low cost of manufacture with regard to both materials and labor, and which accordingly is then susceptible of low prices of sale to the consuming public, thereby making such neck cradles economically available to the buying public.

Still yet another object of the present invention is to provide a new and improved neck cradle which provides in the apparatuses and methods of the prior art some of the advantages thereof, while simultaneously overcoming some of the disadvantages normally associated therewith.

Still another object of the present invention is to provide a new and improved neck cradle providing a portable neck support device.

Yet another object of the present invention is to provide a new and improved neck cradle employing a flexible rodlike member to apply user induced massage of the occipital ridge portion of an individual's neck.

Even still another object of the present invention is to provide a new and improved neck cradle providing support of the occipital ridge portion of a human neck thereby stimulating therapeutic relief of muscle tension in the neck and shoulder regions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a fragmentary side sectional view of a neck cradle taken substantially upon a plane indicated by the section line 5—5 of FIG. 4.

FIG. 6 is a side elevational view of an alternate embodiment of the neck cradle showing an occipital ridge support member comprising a plurality of beadlike elements.

DESCRIPTION OF THE PREFERRED EMBODIMENT

Figure 1:
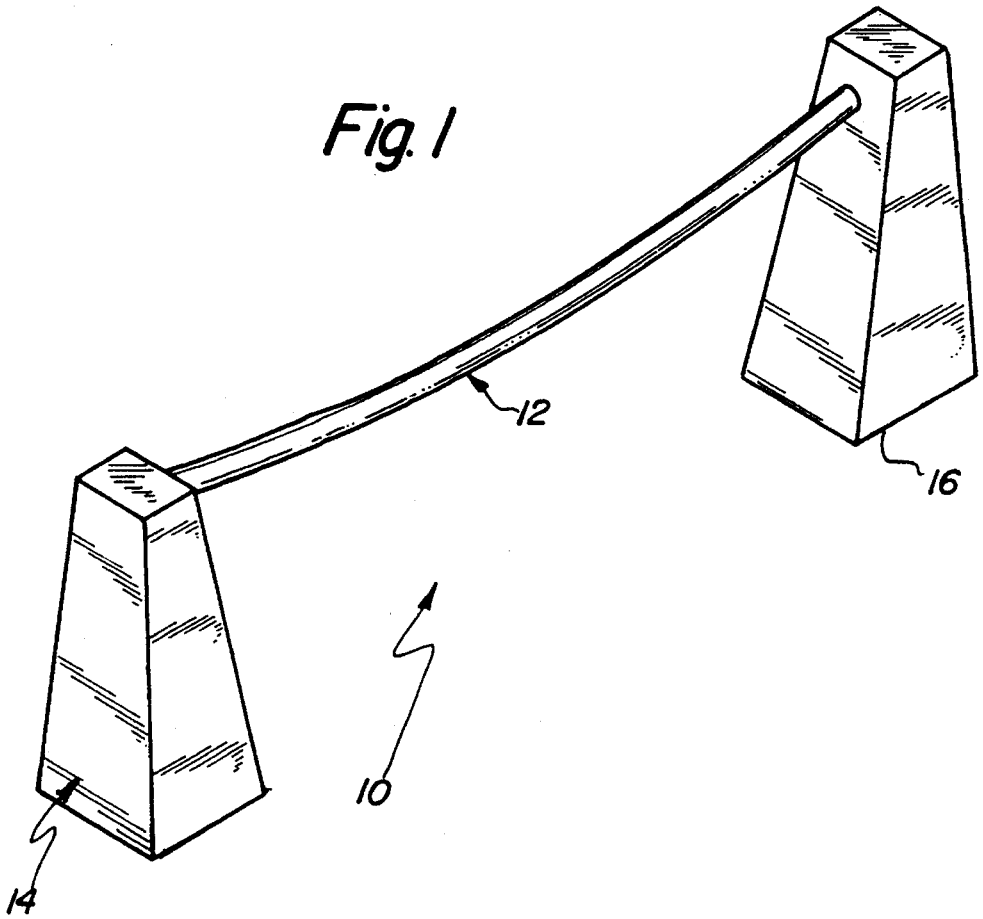
FIG. 1 is a perspective view of the neck cradle showing the flexible rodlike member and supports thereof.

With reference now to the drawings, and in particular to FIG. 1 thereof, a new and improved neck cradle embodying the principles and concepts of the present invention and generally designated by the reference numeral 10 will be described.

From an overview standpoint, the neck cradle is adapted for use with a human desirous of undertaking therapeutic stimulation and relaxation of the neck by lying prone facing upward and resting the occipital ridge neck region on an horizontally disposed elongated rodlike member 12. See FIG. 1. Support members 14 provide a spacing for rodlike member 12 above a substantially horizontal surface upon which the neck cradle 10 rests. Further therapeutic and relaxation effects are achievable by rotating the neck slightly in a side to side motion while resting the neck upon rodlike member 12.

Figure 2:
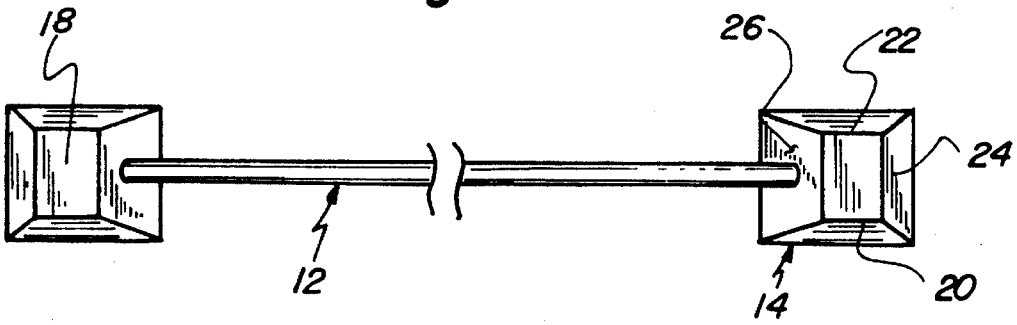
FIG. 2 is a side elevational view of the neck cradle.

More specifically, it will be noted that the neck cradle 10 comprises an elongated flexible rodlike member 12 disposed between two support members 14. See FIG. 2. Support members 14 may be of wooden, plastic, metallic, or cementitious composition and may be further ballasted using solid or liquid weights internally or externally disposed thereon for the purpose of enhancing stability. Support members 14 comprises substantially truncated pyramidal solids having six sides thereof wherein a first side 16 is substantially rectangular in shape and is of sufficient dimension such that in combination with the weight of support member 14 renders any rotational motion thereof as experienced in tipping difficult or substantially impossible under ordinary conditions of use. Second side 18 comprises a foreshortening of a pyramidal shape wherein a normal termination would be a pointed form. Third side 20 and fourth side 22 are substantially mirror images and form trapezoidal shapes joining an edge of second side 18 to first side 16 and furthermore outlining the slope of fifth side 24 and sixth side 26. Fifth side 24 and sixth side 26 are trapezoidal in shape and join an edge of second side 18 to first side 16. A slope of fifth side 24 measured as an acute angle included between first side 16 and fifth side 24 is greater than a slope of sixth side 26 measured as an acute angle included between first side 16 and sixth side 26 for the purpose of providing a greater reactive moment opposing rotation of support member 14 induced by forces disposed upon rodlike member 12.

Rodlike member 12 comprises a solid rod or tube having a resilient quality and sufficient length to enable placement of the neck of an individual thereupon while producing a slight droop under influence of the weight of a human neck. The droop applies pressure over a larger linear contact area reducing the force applied to a specific neck area thereby providing a first modality. Or a substantially rigid rodlike member 12 may be employed to apply pressure with more central disposition at the atlanto-occipital ridge thereby providing a second modality. Rodlike member 12 may be a solid rod of substantially circular cross section, an hollow tube of substantially circular cross section, or a composite elongated structure. A solid rodlike member 12 may be of wooden or polymeric composition and may include structural polymers such as polyurethane foams. An hollow tubular rodlike member 12 may be of metallic, wooden, or polymeric composition. A composite rodlike member 12 may comprise an elongated tube filled to an extent with a foamed polymer, a liquid, a granular substance, or a second loosely engaging elongated member. The composite rodlike member 12 having a loosely engaging elongated member therein may be employed to control the flexibility of a rodlike member 12 by limiting the arc formed therein whenever a portion of the weight of the user's neck and head are disposed thereon. A covering for any and all rodlike members 12 comprising a thin clothlike layer or a thickened polymeric foam layer which may be formed in tubular form and slipped over rodlike member 12 prior to assembly for use.

Rodlike member 12 engages support member 14 by engaging a hole disposed therein and furthermore adhesives may be employed to permanently fasten rodlike member 12 therein. Or a releasable attachment means may be provided at each end of engagement of rodlike member 12 with support member 14.

Figure 3:
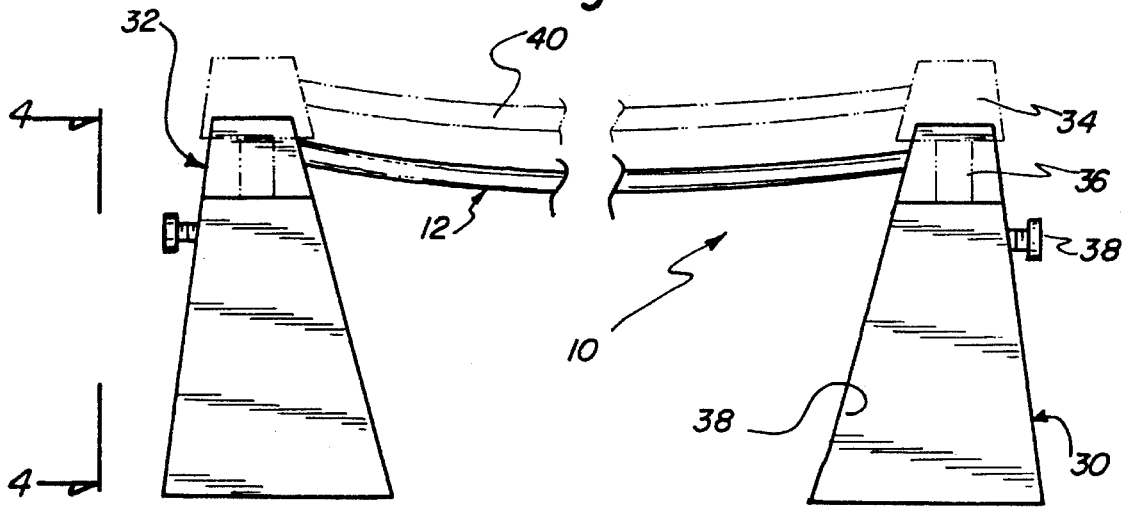
FIG. 3 is side elevational view of the neck cradle showing the extension of adjustable rodlike member supports.
Figure 4:
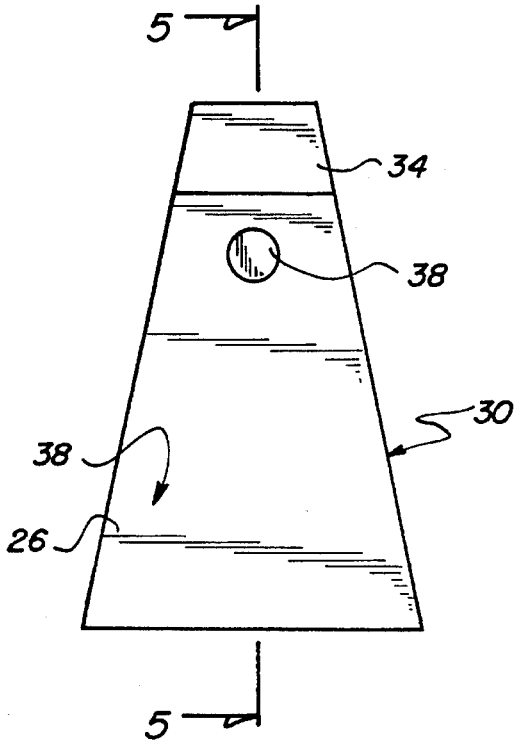
FIG. 4 is a side elevational view of the neck cradle taken substantially upon a plane indicated by the section line 4—of FIG. 3.
Figure 7:
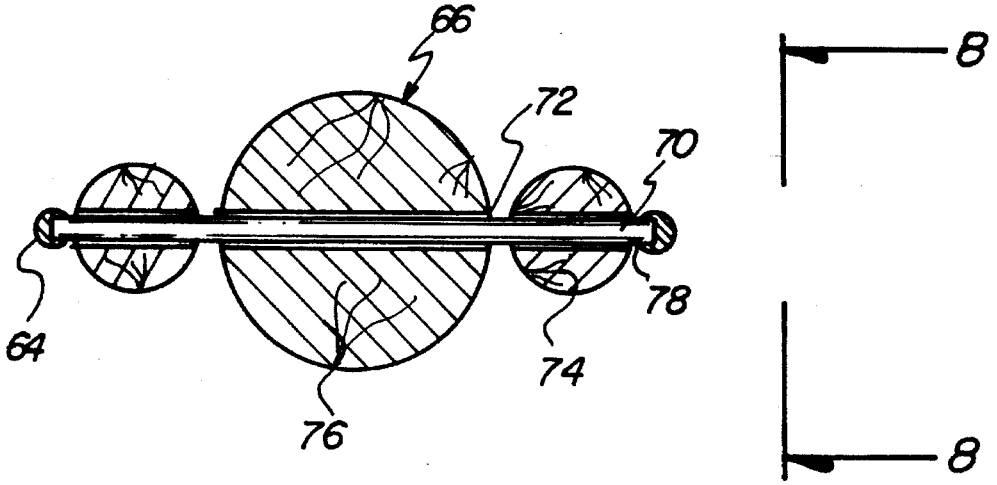
FIG. 7 is a side sectional view of the alternate embodiment of a neck cradle taken substantially upon the plane indicated by the section line 7—7 of FIG. 6.
Figure 8:
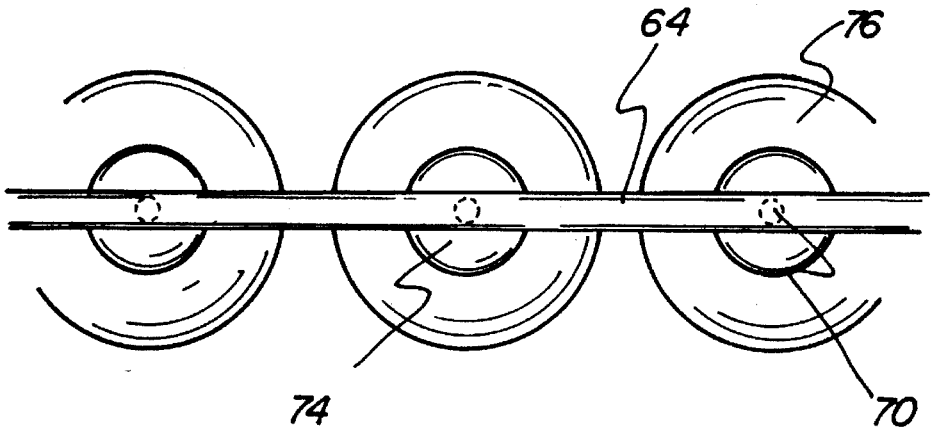
FIG. 8 is a side sectional view of the alternate embodiment of a neck cradle taken substantially upon the plane indicated by the section lines 8—8 of FIG. 7.

In an alternate embodiment, rodlike member 12 is affixed to a pair adjustable supports 30 wherein adjustable supports 30 are substantially geometrically similar to support members 14 having an included height adjustment means 32. See FIGS. 3 and 4. Height adjustment means 32 comprises a rodlike member support portion 34 having an adjustment column 36 affixed thereon, and a locking thumbscrew 38 threadedly engaging base portion 38 and frictionally engaging adjustment column 36. Adjustment column 36 is insertedly disposed within a hole 39 bored into base portion 38 and locked at a suitable location therein using locking thumbscrew 38. See FIG. 5. Rodlike member 12 may be affixed to rodlike member support portion 34 by an enlarged portion 50 wherein rodlike support member portion 34 is molded or cast therearound. An enlarged terminus of adjustment column 36 affixing the column 36 to rodlike support member 34 may also be moldedly or castedly fastened thereupon. Weight member 54 may comprise a heavy plate or box affixed to adjustable support 30. In use, adjustable columns 36 are each adjusted to a suitable extension from base portion 38 thereby repositioning rodlike member 12 at position 40. Specifics regarding position 40 is generally determined by the user or therapist.

In yet another alternate embodiment, rodlike member 12 is replaced by bead frame 60 which is disposed between two support members 62. See FIG. 6. Support members 62 are substantially similar to support members 14 having a means for affixing bead frame 60 thereto and thereby replacing rodlike member 12. Bead frame 60 comprises a pair of rails 64 having a plurality of beads 66 disposed therebetween. Three beads 66 are disposed upon axle 70, although a lesser or greater quantity of beads may be employed with similar benefit. Beads 66 comprise wooden or polymeric spherical or irregularly shaped members having a centrally disposed through hole 72. Beads 66 are of two varieties, a first small average diameter bead 74 and a second large average diameter bead 76, and furthermore each axle 70 has two small average diameter beads 74 and one large average diameter bead 76 disposed thereon wherein the large diameter bead is located intermediate between the two small diameter beads 74. Rails 64 comprise substantially stiff elongated rods of relatively small cross section and substantially cylindrical in shape. Axles 70 are affixed to rails 64 by engagement with holes 78 disposed at substantially regular intervals therein and may be held in place by adhesives, an interference fit, staking, threaded fastening means, or the expansion of an axle end forming a rivetlike attachment thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved neck cradle for providing neck support to an upward facing prone human comprising:

a resilient elongated rod-like member; and a support member pair wherein each support member is affixed to an end of said rod-like member thereby producing a substantially horizontal operational disposition of said rod-like member, said support member pair further having two substantially solid truncated pyramids having an attachment means for said resilient elongated rod-like member disposed thereon, each said solid truncated pyramid having a first non-horizontally disposed side forming a first acute angle with the horizontal and a second opposed non-horizontal disposed side having an attachment means disposed thereon for forming a second acute angle with the horizontal, and further said first acute angle being greater than said second acute angle.

2. The new and improved neck cradle of claim 1 in which said resilient rodlike member comprises a solid or tubular cylinder greater than six inches long and susceptible to flexure by application of weight exceeding one pound disposed centrally thereon.

3. The new and improved neck cradle of claim 1 in which said rodlike member is of wooden, metallic, or polymeric composition.

4. The new and improved neck cradle of claim 3 in which said rodlike member is covered by a substantially soft fabriclike material.

5. The new and improved neck cradle of claim 1 in which said rodlike member comprises a elongated bar having an elongated flexible tube of greater length than said rigid elongated bar loosely disposed therearound and furthermore said elongated tube is affixed to said support members at each free end thereof.

6. The new and improved neck cradle of claim 1 in which said rodlike member comprises a tube having a central portion filled to any extent by a liquid or solid substance differing in composition from said tube construction.

7. The new and improved neck cradle of claim 1 in which said solid truncated pyramids each comprise a base portion and a rodlike member attachment portion wherein said rodlike member attachment portion further comprises a cylindrical portion slidably engaging a hole bored in said base portion and furthermore said base portion has disposed therein a locking means of releasably locking said cylindrical portion thereto.

8. The new and improved neck cradle of claim 7 in which said locking means comprises a setscrew threadedly engaging said base portion and frictionally engaging said cylindrical portion.

9. The new and improved neck cradle of claim 1 in which said resilient elongated rodlike member comprises a pair of substantially parallely disposed elongated rods having a plurality of axle members disposed substantially orthogonally therebetween and furthermore each axle member has a plurality of beadlike members disposed thereon.

10. The new and improved neck cradle of claim 9 in which said beadlike members comprise a first smaller bead pair each having a centrally disposed through hole loosely engaging said axle and a second larger bead having a centrally disposed through hole loosely engaging said axle wherein said second larger bead is disposed upon said axle between each of said first smaller beads thereon.

* * * * *